US007963260B2

(12) United States Patent
Kreuter et al.

(10) Patent No.: US 7,963,260 B2
(45) Date of Patent: Jun. 21, 2011

(54) SWITCHABLE VALVE ACTUATING MECHANISM

(75) Inventors: Peter Kreuter, Aachen (DE); Rüdiger Erz, Baesweiler (DE)

(73) Assignee: Meta Motoren- und Energie-Technik GmbH, Herzogenrath (DE)

( * ) Notice: Subject to any disclaimer, the term of this patent is extended or adjusted under 35 U.S.C. 154(b) by 458 days.

(21) Appl. No.: 12/063,217

(22) PCT Filed: Jul. 26, 2006

(86) PCT No.: PCT/EP2006/007365

§ 371 (c)(1),
(2), (4) Date: Feb. 7, 2008

(87) PCT Pub. No.: WO2007/017109

PCT Pub. Date: Feb. 15, 2007

(65) Prior Publication Data

US 2010/0162979 A1 Jul. 1, 2010

(30) Foreign Application Priority Data

Aug. 8, 2005 (DE) ..... 10 2005 037 391
Aug. 19, 2005 (DE) ..... 10 2005 039 368

(51) Int. Cl.
*F01L 1/34* (2006.01)

(52) U.S. Cl. ..... 123/90.16; 123/90.39; 123/90.44; 74/569

(58) Field of Classification Search ..... 123/90.16, 123/90.39, 90.44; 74/559, 567, 569
See application file for complete search history.

(56) References Cited

U.S. PATENT DOCUMENTS

| | | | | |
|---|---|---|---|---|
| 4,768,467 | A * | 9/1988 | Yamada et al. | 123/90.16 |
| 5,297,516 | A | 3/1994 | Hara | |
| 5,655,488 | A | 8/1997 | Hampton et al. | |
| 6,591,798 | B2 | 7/2003 | Hendriksma et al. | |
| 6,923,151 | B2 * | 8/2005 | Kreuter | 123/90.16 |
| 2002/0002959 | A1 | 1/2002 | Suzuki | |
| 2002/0124820 | A1 | 9/2002 | Kreuter | |
| 2003/0024502 | A1 | 2/2003 | Kreuter | |
| 2003/0209216 | A1 | 11/2003 | Kreuter | |
| 2003/0213930 | A1 | 11/2003 | Kreuter | |
| 2004/0003789 | A1 | 1/2004 | Kreuter | |
| 2004/0065298 | A1 | 4/2004 | Kreuter | |
| 2004/0177820 | A1 | 9/2004 | Kreuter et al. | |

FOREIGN PATENT DOCUMENTS

| | | |
|---|---|---|
| JP | 3-33414 | 2/1991 |
| JP | 4-132812 | 5/1992 |

* cited by examiner

*Primary Examiner* — Ching Chang
(74) *Attorney, Agent, or Firm* — Muncy, Geissler, Olds & Lowe, PLLC

(57) ABSTRACT

A valve actuation device may comprise a camshaft including first and second cams, the second cam having a larger lobe than the first cam. A valve lever includes a first follower component or surface adapted to follow the first cam and a second follower component or surface adapted to follow the second cam. The second follower component or surface may be mounted on or defined by an eccentrically-disposed device, which is rotatable relative to the first follower component or surface. When the rotatability of the second follower component or surface is locked by a latching device, the second follower surface translates the contour of the second cam into actuation of an engine valve and, when the second follower component or surface is freely rotatable, the first follower surface translates the contour of the first cam into actuation of the engine valve.

12 Claims, 7 Drawing Sheets

SWITCHABLE VALVE ACTUATING MECHANISM

CROSS-REFERENCE

This application is the U.S. national stage filing of International Application No. PCT/EP2006/007365 filed Jul. 26, 2006, which claims priority to German patent application nos. 10 2005 037 391.7 filed Aug. 8, 2005 and 10 2005 039 368.3 filed Aug. 19, 2005.

TECHNICAL FIELD

The invention relates to a switchable valve actuating mechanism, as is used, e.g., in reciprocating-piston internal combustion engines for switching the valve timing of an intake valve.

Switchable valve actuating mechanisms are in use in a variety of ways and serve to adapt the valve timing to differing operating conditions in order to favorably influence the power development, the torque behavior and the exhaust gas ratio.

A switchable valve actuating mechanism according to the preamble of claim 1 is known from DE 102 30 108 B4. With this apparatus for adjusting the stroke length of a valve actuated by a camshaft, a bearing pin is rotatably borne on the valve lever, which bearing pin includes two bearing segments that are eccentric relative to its rotational axis; a cam roller that follows one of the cams of the camshaft is borne on each bearing segment. The bearing pin is connected with a friction disk so as to rotate therewith; the outer circumference of the friction disk is in frictional engagement with a circumferential surface of the camshaft for rotating the bearing pin. The rotatability of the friction disk is lockable in different rotational positions.

SUMMARY

The object underlying the invention is to provide a switchable valve actuating mechanism, which operates with low friction in a compact construction and makes possible a reliable switching of the valve actuation from one cam of a camshaft to another cam of the camshaft.

In one aspect of the present teachings, a switchable valve actuation mechanism includes a camshaft having at least one first cam and one second cam that is higher than the first cam. A valve lever is supported on an engine-mounted component and on the to-be-actuated valve. The valve lever includes a first follower component adapted to follow the first cam and a second follower component adapted to follow the second cam. The second follower component is mounted on an eccentric device, which is rotatably borne on and/or in the valve lever. A latching mechanism is adapted to latch or lock the rotatability of the eccentric device. Preferably, when the rotatability of the eccentric device is latched, the second follower component translates the contour of the second cam into a corresponding actuation of the valve. On the other hand, when the eccentric device is freely rotatable, the first follower component translates the contour of the first cam into a corresponding actuation of the valve.

With the inventive valve actuating mechanism, the first follower component follows the contour of the first cam when the eccentric device is freely rotatability, so that the eccentric device must be rotated only by a predetermined rotational amount or angle in order to be positioned to follow the second follower component, at which position the rotatability of the eccentric device is latched. Additional components are not required to rotate the eccentric device.

In a further aspect of the present teachings, the valve lever may include two spaced-apart side parts. An opening may extend through the spaced-apart side parts and may be dimensioned to bear the eccentric device. The first follower component may include a follower surface disposed concentrically to the rotational axis of the eccentric device. The follower surface is preferably accessible between the side parts for abutment on the first cam.

The first follower component is preferably a roller that is borne concentrically to the rotational axis of the eccentric device. The eccentric device may be borne in a bushing that is inserted in the opening of the side parts. The roller preferably forms the first follower component and is borne on or in the bushing.

The second follower element is also preferably a roller that is borne on a bearing pin. Preferably, the bearing pin protrudes laterally from the eccentric device and is radially displaced from the rotational axis of the eccentric device.

In further aspects of the present teachings, the movability of the eccentric device into and out of its latchable rotational position may be achieved in a particularly simple manner. For example, a spring may be supported between the eccentric device and the valve lever. The spring preferably biases the eccentric device in the direction of abutment of the second follower component on the second cam. In addition or in the alternative, the latching mechanism may include a connecting lever connected with the eccentric device so as to rotate therewith. The position of the connecting lever is preferably latchable relative to the valve lever when the second follower component abuts on the base circle of the second cam. In addition or in the alternative, a locking component may be mounted on the valve lever. The locking component may be capable of reciprocating between a first position, in which the pivotability of the connecting lever is locked, and a second position, in which the connecting lever is permitted to pivot. In addition or in the alternative, the locking component may be formed as a shift pin that is displaceable against the biasing force of a spring by applying a hydraulic pressure to the shift pin. In addition or in the alternative, the engine-mounted component, on which the valve lever is supported, may be formed as a hydraulic valve play-compensating element, which is adapted to bias the shift pin using hydraulic pressure.

In a further aspect of the present teachings, a second follower component may be provided on each side of the eccentric device. In this case, the second follower components interact with respective second cams, thereby symmetrically depressing or actuating the valve lever.

The invention, which can be utilized for substantially all types of camshaft-actuated valves and which allows a switching between two differing opening curves, of which one can be a null-actuation, is explained in an exemplary manner in the following with the assistance of schematic drawings and with further details.

DETAILED DESCRIPTION OF THE INVENTION

Figure 2:
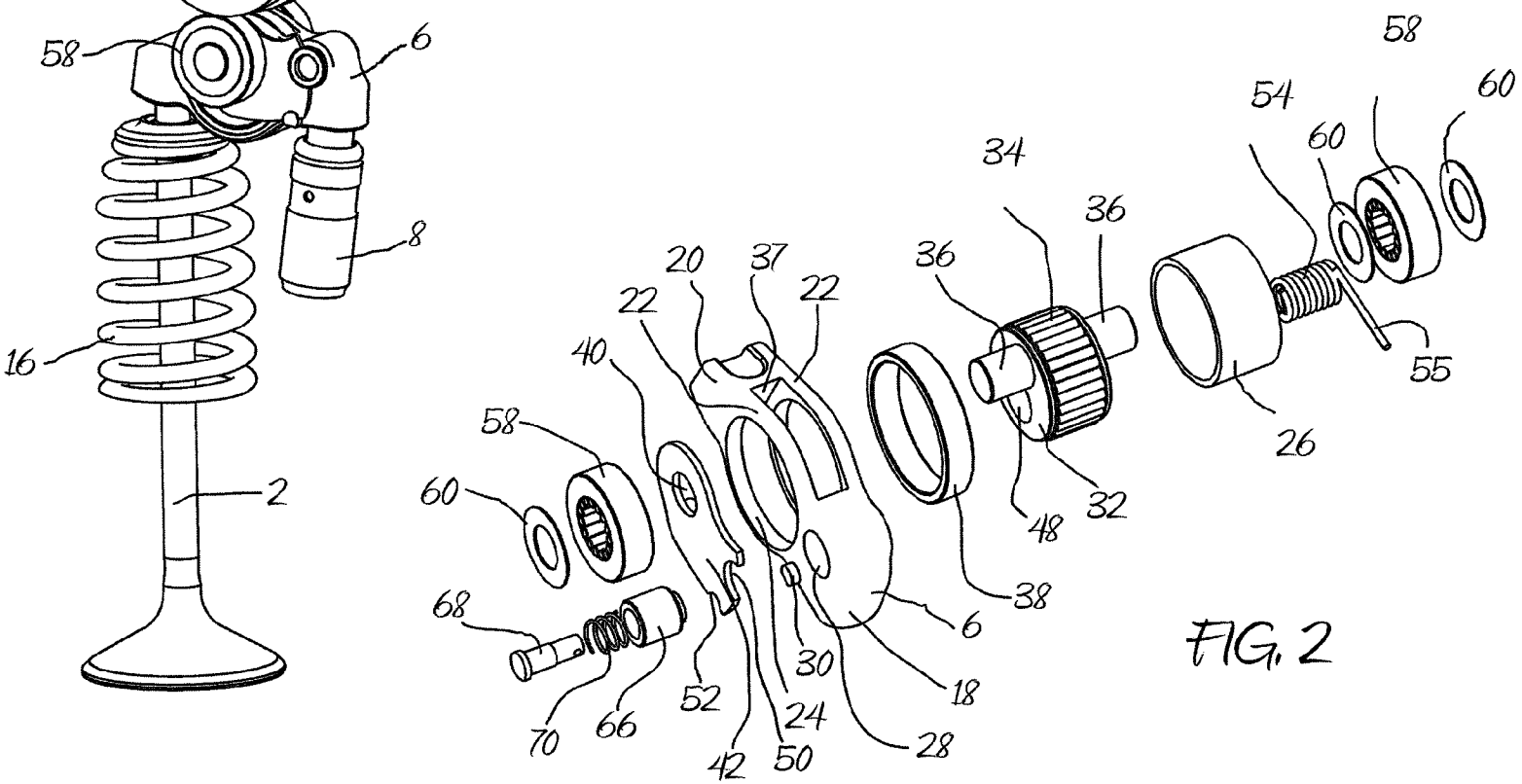
FIG. 2 shows parts of the valve actuating mechanism of FIG. 1 in exploded illustration.

A charge exchanging valve 2, for example an intake valve of an internal combustion engine, according to the Figures is actuated by a camshaft 4 with a valve lever 6 disposed therebetween. One end of the valve lever 6 is supported on a known hydraulic valve play-compensating element 8 and the other end is supported on the shaft of the valve 2; the valve lever 6 abuts on cams 12 and 14, respectively, between the ends of the valve lever 6 in a manner that will be further discussed below. As is apparent, a middle first cam 12 is formed with a smaller lobe than second, side cams 14, which accommodate the first cam 12 therebetween. A valve closing spring is denoted with 16. The hydraulic valve play-compensating element 8 acts so that the valve lever 6 is in play-free abutment on at least one of the cams and on the shaft of the valve, respectively.

FIG. 2 shows the valve lever 6 and the components mounted thereon in exploded perspective illustration.

The valve lever 6 includes two end portions 18 and 20, which are connected to each other via spaced-apart side parts 22. A bushing-accommodation opening 24 penetrates through the side parts 22; a bushing 26 is insertable in the opening 24.

The end portion 18, which abuts on the valve play-compensating element 8, has a hollow interior and includes a side opening 28.

As shown in FIG. 2, a stop 30 is formed on the lower, left side of the end portion 18. An eccentric device 32 is insertable into the bushing 26; cylindrical roller elements 34 are disposed along the eccentric device 32 so that the eccentric device 32 is rotatable in the bushing 26.

Bearing pins 36 project from the side surfaces of the eccentric device 32 eccentrically to the rotational axis of the eccentric device 32, which rotational axis is coaxial to the axis of the bushing 26 in the assembled state; the bearing pins 36 are coaxially aligned.

A follower ring and/or a follower roller 38 is insertable in a slot 37 formed between the side parts 22 of the valve lever 6; the inner side of the follower roller 38 is provided with not-illustrated roller elements; the follower roller 38 is borne by these roller elements in a state slidable on the bushing 26.

Figure 6:
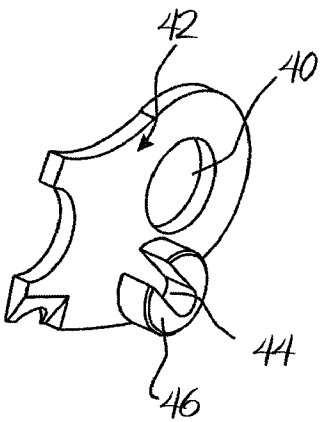
FIG. 6 shows a perspective view of a connecting lever.

A hole 40 of a connecting lever 42 is slidable onto the left bearing pin 36 according to FIG. 2; the connecting lever 42 includes a lateral projection 46 (FIG. 6) formed with a slot 44, which projection 46 fits in a through-opening 48 of the eccentric device 32. One end portion of the connecting lever 42 includes a recess 50 and an abutment surface 52.

Figure 4:
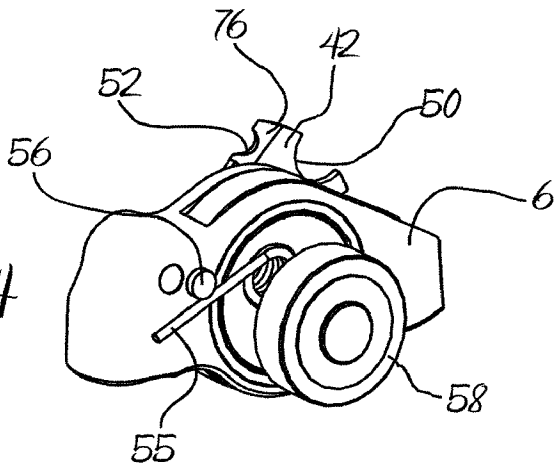
FIGS. 4 and 5 show different perspective views of a valve lever with accompanying components.
Figure 9:
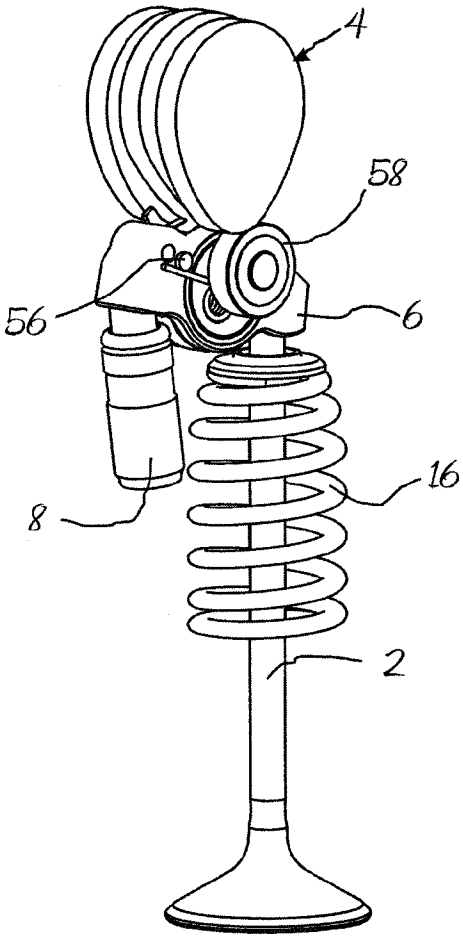
FIGS. 7 to 9 show different perspective views similar to FIG. 1 in different functional states.
Figure 8:
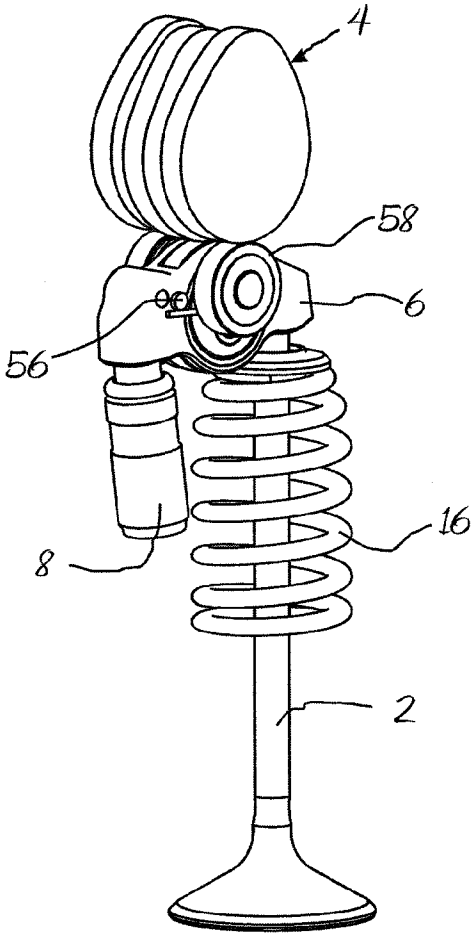

A torsion spring 54 is insertable into the through-opening 48; one end leg (not illustrated) of the torsion spring 54 can engage in the slot 44 of the connecting lever and the other end leg 55 of the torsion spring 54 can be supported on a protrusion 56 of the valve lever 6 (cf. FIGS. 4, 8 and 9).

Follower rings and/or follower rollers 58 can be borne on the bearing pins 36 via roller elements provided in the follower rollers 58. The follower rollers 58 are advantageously disposed on the bearing pins 36 between washers 60, wherein the outer washers 60 are advantageously formed as locking rings that axially secure the follower rollers 58 on the bearing pins 36.

Figure 3:
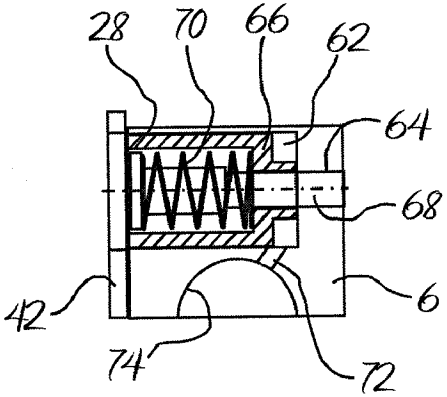
FIG. 3 shows a cross-section through a locking mechanism.

The end portion 18 of the valve lever 6 includes a cylindrical cavity 62 that ends in the opening 28 at the left according to FIG. 3 and merges in a bore 64 to the right.

A piston 66, which has a U-shaped cross-section as a whole, is inserted in the cavity 62; the piston 66 is held by a pin 68 that penetrates through the piston body and is screwed into the bore 64. A spring 70 is supported between the pin 68 and the piston 66. A portion of the cavity 62, which is located to the right of the piston body in FIG. 3, is connected with a recess 74 via a passage 72; the valve lever 6 abuts on the valve play-compensating element 8 via the recess 74. The passage 72 and thus the piston 66 are biased with hydraulic pressure from the valve play-compensating element 8.

The components illustrated in FIG. 2 are assembled, for example, as follows:

The follower roller 38 is introduced into the slot 37 of the valve lever 6. The bushing 26 is then inserted, so that the bushing is held in the opening 24 and the follower roller 38 is rotatably borne on the bushing 26. The eccentric device 32 is inserted into the bushing 26, so that the eccentric device 32 is rotatable as a whole about the axis of the bushing 26. The torsion spring 54 is inserted into the through-opening 48 of the eccentric device 32. Then, the connecting lever 42 and one follower roller 58 are pushed from one side onto one bearing pin 36 and the other follower roller 58 is pushed onto the other bearing pin 36, wherein washers are disposed in between if desired. The follower rollers 58 are secured on the bearing pins 36 by lock washers.

The piston 66 is inserted into the opening 28 and is secured by the pin 68; the spring 70 is disposed therebetween.

The resulting assembly is disposed on the valve play-compensating element and the shaft of the valve 2. The legs of the torsion spring 54 are mounted such that the connecting lever 42 and the eccentric device 32, which is connected with the connecting lever 42 so as to rotate therewith, respectively, are pretensioned for one rotation in the clockwise direction, i.e. the follower rollers 58 are pretensioned into abutment on the corresponding second cams 14.

Figure 1:
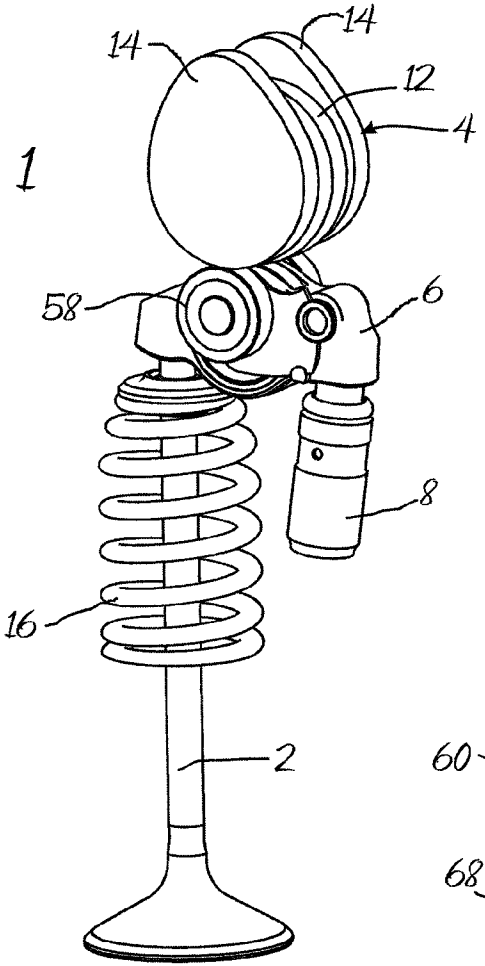
FIG. 1 shows a perspective overall view of a valve actuating mechanism.
Figure 5:
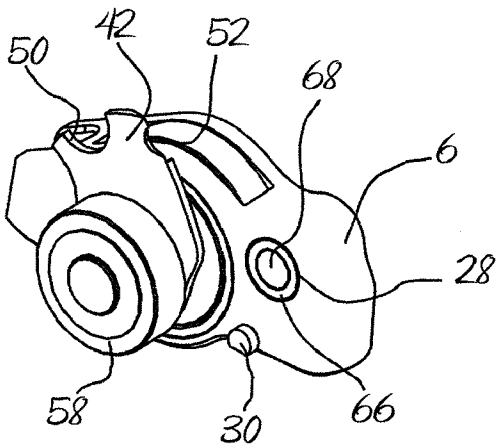

When the camshaft 4 is rotated from the rotational position illustrated in FIG. 1, in which the base circles of the cams abut on the follower rollers 58 and 38, the follower rollers 58 are downwardly urged (see position shown in FIG. 5) in the counter-clockwise direction due to pivoting of the connecting lever 42, wherein the eccentric device 32 rotates about the axis of the bushing 26 in a corresponding manner. The valve lever 6 is pivoted about the valve play-compensating element 8 by the first cam 12, which abuts on the follower roller 38, in accordance with the cam lobe of the first cam 12 for actuation of the valve 2.

When the lobes of the second cam 14 have passed the follower rollers 58, the follower rollers 58 return upwardly in the clockwise direction due to the pivoting of the connection lever 42. The connecting lever 42 can advantageously pivot in the clockwise direction until its abutment surface 52 abuts on the stop 30. In this position of the connecting lever 42, the recess 50 aligns with the opening 28, so that the piston 66 can extend due to the biasing by the hydraulic pressure and can enter into the recess 50, whereby the connecting lever 42 is latched relative to the valve lever 6. In the latched state, the valve lever 6 is actuated in accordance with the larger lobes of the second cams 14, whereby the first cam 12 comes free from the follower roller 38.

The locking of the connecting lever 42 can be released by reducing the hydraulic pressure acting on the piston 66 when the cam base circle is again passed over and the piston is pushed back into the valve lever 6 by the spring 70.

The connecting lever 42 is advantageously provided with a bevel 76 (FIG. 4) in the region of the abutment surface 52; the bevel 76 ensures that, when the connecting lever 42 pivots into abutment on the stop 30, the piston 66, which acts as a pin, is pushed back.

Figure 7:
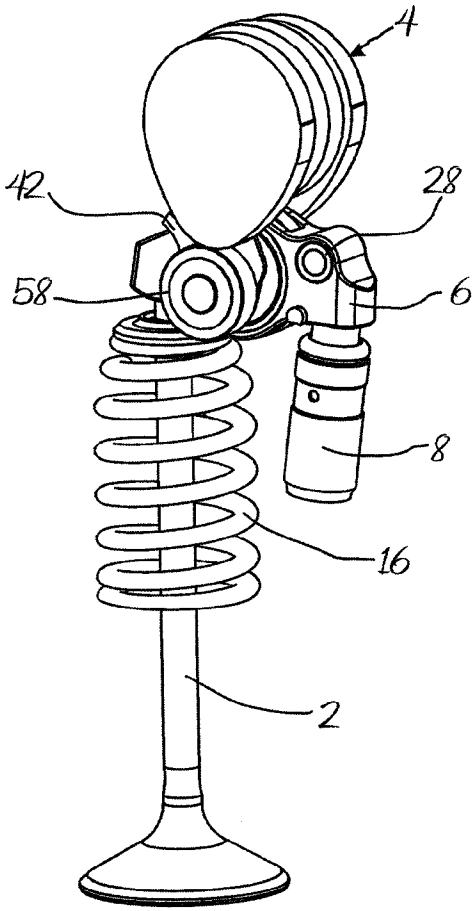

FIGS. 7 to 9 show the arrangement of FIG. 1 in different perspective views and functional states. FIG. 7 shows a position, in which the second cams are ineffective, i.e. the connecting lever is unlatched. FIGS. 8 and 9 respectively show a null stroke position and a substantially full stroke position when the connecting lever is latched.

As is derivable from the preceding discussion, the inventive switchable valve actuating mechanism is very compactly constructed and includes slightly-moved inertial masses and a high stiffness. Further, the engagement of the cams takes place via the borne follower rollers 58 and 38, which leads to low friction and thus fuel consumption advantages.

A sufficient energy storage capacity of the spring 54, which provides for a secure abutment of the follower rollers 58 on the cams 14, is important for the functional efficiency of the described valve actuating mechanism. In particular, at high rotational speeds, it must be ensured that the follower rollers 58 are always abutting the cams 14.

Figure 10:
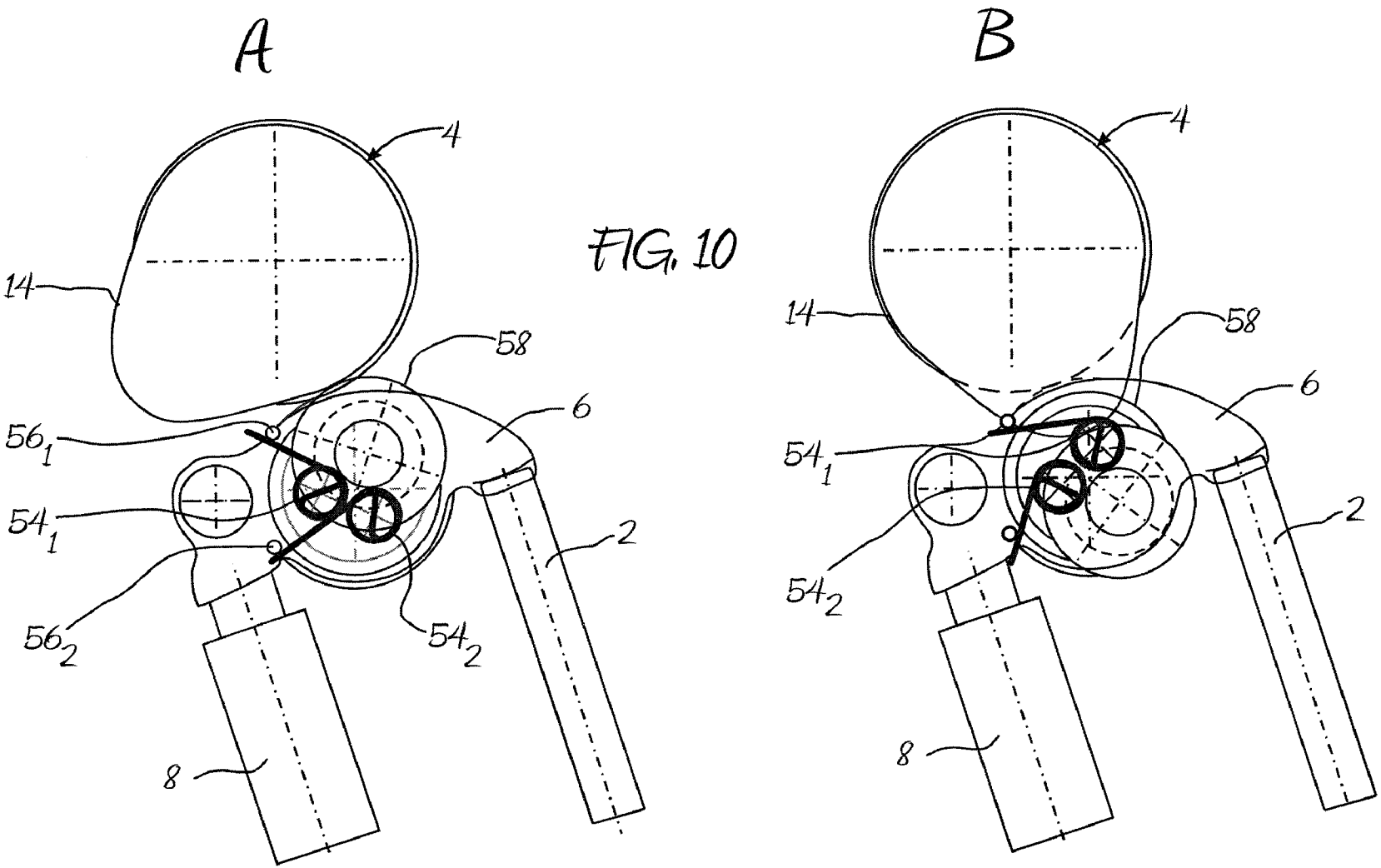
FIGS. 10 to 13 show side views of 4 embodiments, differing with respect to a spring device, of the valve actuating mechanism, each in two different positions.

FIG. 10 shows an embodiment, which is modified as compared to the described embodiment, in a side view similar to the view according to FIG. 4.

In the embodiment according to FIG. 10, two torsion springs $\mathbf{54}_1$ and $\mathbf{54}_2$ are inserted into two corresponding through-openings 48 (in FIG. 10—not numbered) in place of the one torsion spring 54; the torsion springs $\mathbf{54}_1$ and $\mathbf{54}_2$ are supported on two protrusions $\mathbf{56}_1$ and $\mathbf{56}_2$ of the valve lever 6 and accordingly in two slots of opposing stops, which are formed on the connecting lever 42. On the left in FIG. 10, the arrangement is illustrated with the follower roller abutting on the base circle of the cam 14. On the right in FIG. 10, the arrangement is illustrated with the not-latched connecting lever and follower roller 58 maximally pivoted by the cam lobe of the cam 14 and the maximally-pivoted connecting lever 42, respectively, wherein the cam 14 is ineffective for the actuation of the valve and in the illustrated example (null stroke), the inner cam 12 does not cause actuation of the valve. In this embodiment, which can switch between null stroke (no valve actuation) and valve actuation by the cams 14, the follower roller 38 is not required to be provided.

Figure 11:
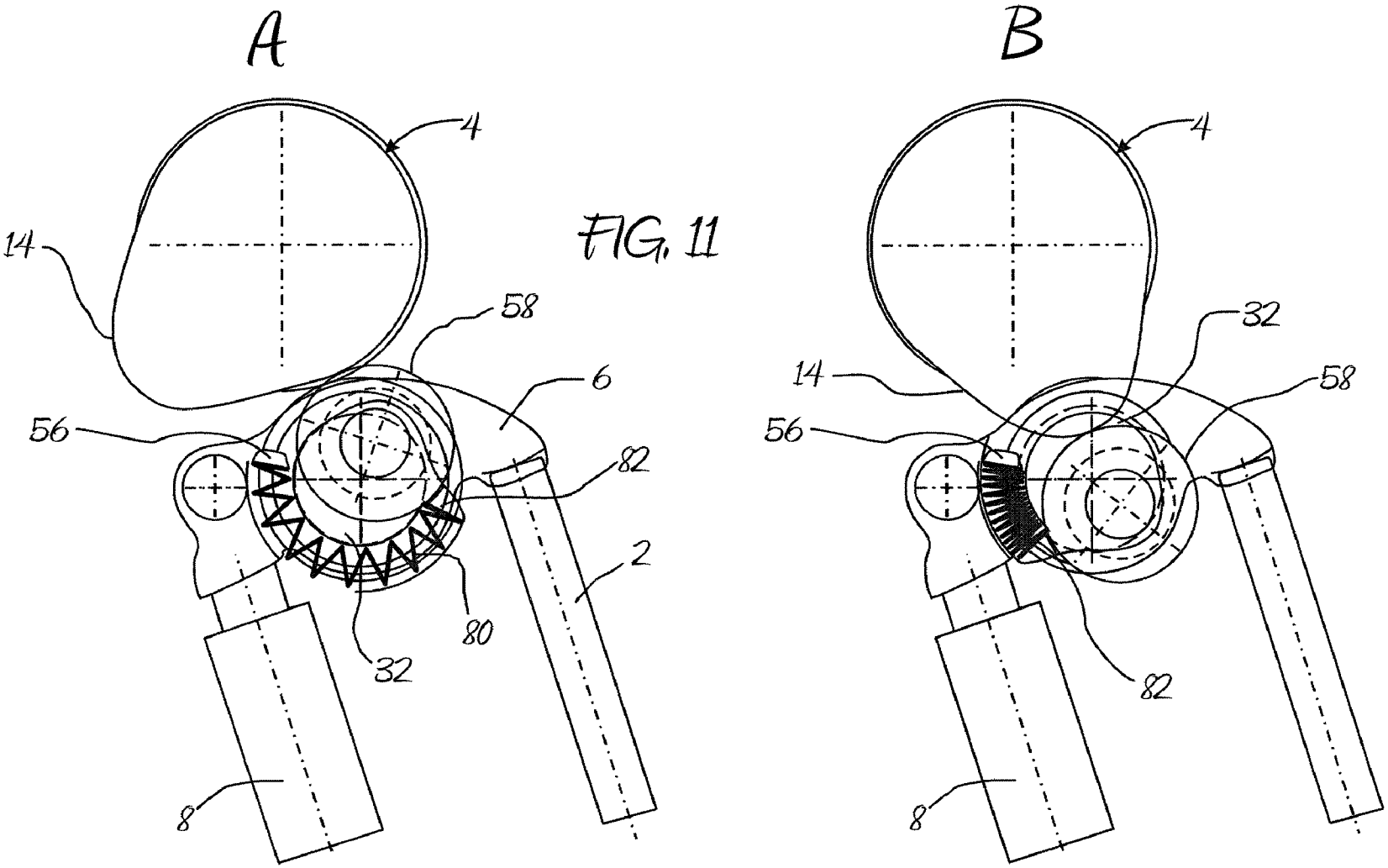

In the embodiment according to FIG. 11, a curved helical spring 80 is utilized in place of the torsion spring(s); the helical spring 80 is supported between the protrusion 56 and/or stop formed on the valve lever 6 and another stop 82, which is rigidly connected with the eccentric device 32 and thus is connected with the connecting lever 42 so as to rotate therewith. On the left in FIG. 11, the state of the helical spring 80 is illustrated when the follower roller 58 abuts on the cam base circle. On the right, the state is illustrated, in which the helical spring is maximally compressed, so that it holds the follower roller 58 in secure abutment on the cam 14 after the cam 14 has passed over the following roller 58.

Figure 12:
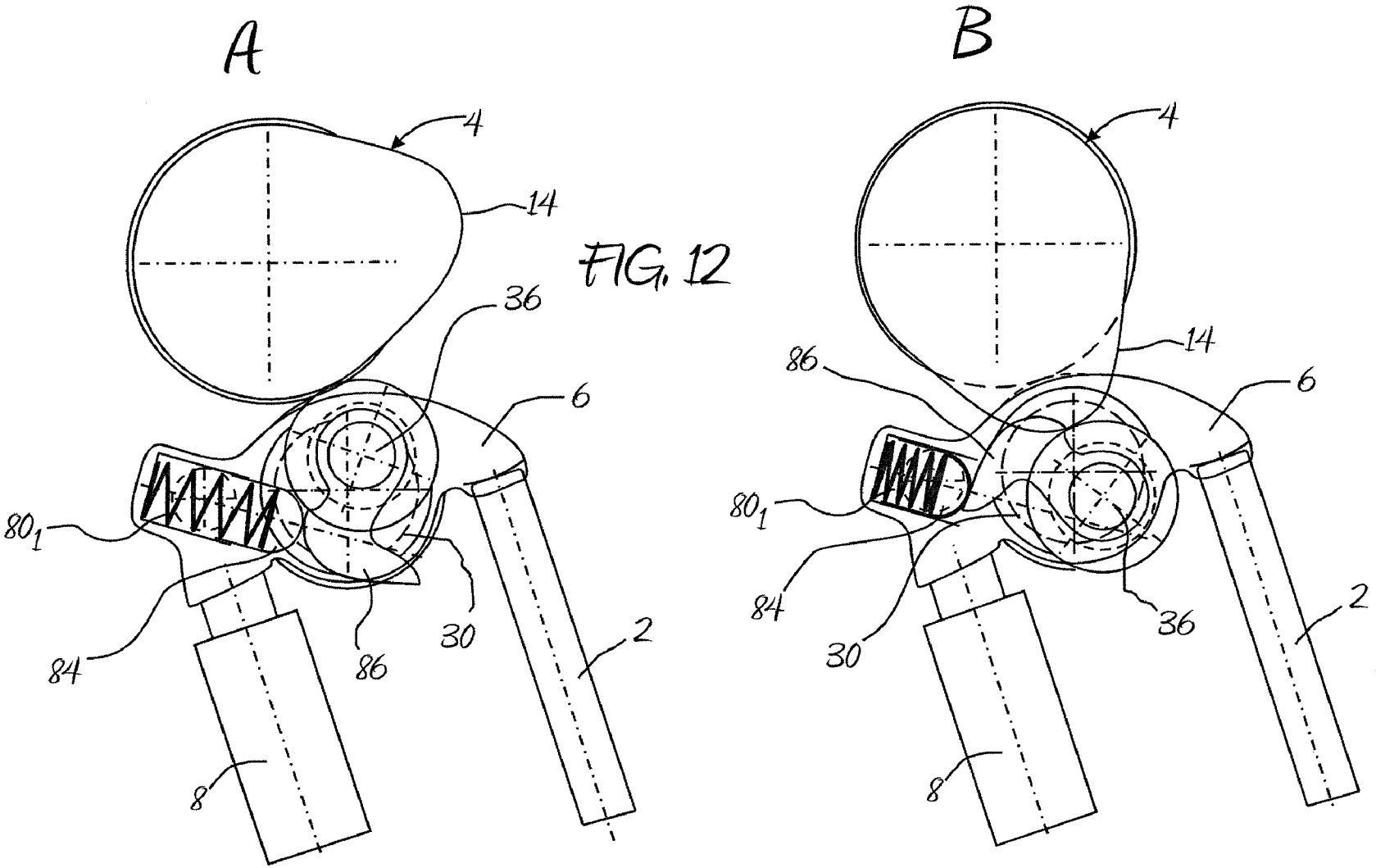

In the embodiment according to FIG. 12, a helical spring $\mathbf{80}_1$, which operates in a bore of the valve lever 6, is utilized in place of the curved helical spring 80 of FIG. 11; the helical spring $\mathbf{80}_1$ is supported on a cam surface via a push rod 84; the push rod 84 is formed on a cam arm 86 that is connected so as to rotate with the eccentric device 32 and/or is rigidly connected with bearing pins 36 connected with the eccentric device 32. The function of the arrangement according to FIG. 12 otherwise corresponds to the function of FIG. 11.

Figure 13:
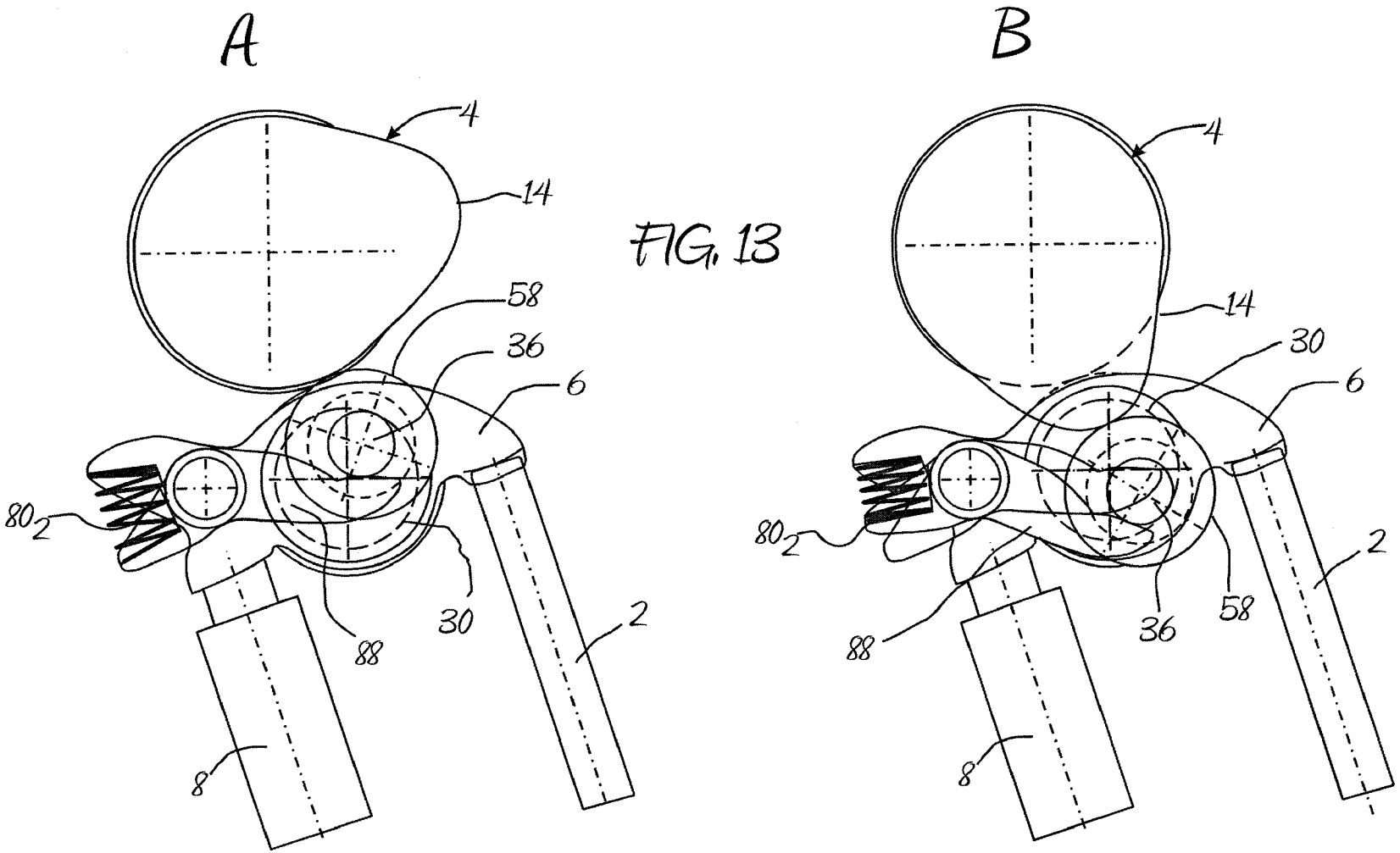

In the embodiment according to FIG. 13, a tilting lever 88 borne on the valve lever 6 is utilized in place of the cam arm of FIG. 12; one end of the tilting lever 88 follows the rotation of the eccentric device 32 and/or the movement of a bearing pin 36 rigidly connected with the eccentric device 32; a helical spring $\mathbf{80}_2$ is supported between the other end of the tilting lever 88 and the valve lever 6. The function of the embodiment according to FIG. 13 otherwise corresponds to the function of FIG. 12.

The above-described embodiments of return springs are only exemplary and can be modified in various ways and/or can be combined with each other.

The inventive valve actuating mechanism can be modified in various ways. The locking of the rotatability of the eccentric device can take place electromagnetically or in some other way. It is not required to provide three cams and three follower rollers. The illustrated embodiment provides, however, high symmetry and freedom from tilting forces that want to tilt the valve lever about its longitudinal axis. The adjustable engagement mechanism is not required to be disposed between the support, which is mounted on the engine housing, and the support on the valve of the lever. The components, which follow the cam contours, are not required to be rotatably borne, but rather can also be formed directly on the bushing and the bearing pin. The described rotatable bearing of the components located in direct abutment on the cams, as well as the rotatable bearing of the eccentric device inside of the valve lever, have the advantage, however, of very-low friction and high durability. The rotational direction of the eccentric device can be reversed relative to the illustrations. The connecting lever and the spring(s) can be disposed on the same or different sides of the valve lever, etc.

REFERENCE NUMBER LIST

2 Charge exchanging valve
4 Camshaft
6 Valve lever
8 Valve play-compensating element
12 Cam
14 Cain
16 Closing spring
18 End portion
20 End portion
22 Side part
24 Bushing-accommodation opening
26 Bushing
28 Opening
30 Stop
32 Eccentric device
34 Roller element
36 Bearing pin
38 Follower roller
40 Hole
42 Connecting lever
44 Slot
46 Projection
48 Through-opening
50 Recess
52 Abutment surface
54 Torsion spring
55 End leg
56 Protrusion
58 Follower roller
60 Washer
62 Cavity
64 Bore
66 Piston
68 Pin

70 Spring
72 Passage
74 Recess
76 Bevel
80 Helical spring
82 Stop
84 Push rod
86 Cam arm
88 Tilting lever

The invention claimed is:

1. A device for actuating an engine valve, comprising:

a camshaft having at least one first cam and at least one second cam, a cam lobe of the second cam having a higher elevation than a cam lobe of the first cam, a valve lever configured to be supported on an engine-mounted component and on the engine valve, a first follower component configured to follow the first cam, a second follower component configured to follow the second cam, an eccentric device pivotably borne on or in the valve lever, the second follower component being mounted on the eccentric device, and a latching device configured to selectively lock the pivotability of the eccentric device relative to the valve lever, wherein the valve lever and the eccentric device are configured such that, when the pivotability of the eccentric device relative to the valve lever is locked by the latching device, the second follower component translates the contour of the second cam into a corresponding actuation of the engine valve, and when the eccentric device is freely pivotable relative to the valve lever, the first follower component translates the contour of the first cam into a corresponding actuation of the engine valve.

2. A device for actuating an engine valve, comprising:

a camshaft having at least one first cam and at least one second cam, a cam lobe of the second cam having a higher elevation than a cam lobe of the first cam, a valve lever configured to be supported on an engine-mounted component and on the engine valve, a first follower component configured to follow the first cam, a second follower component configured to follow the second cam, an eccentric device pivotably borne on or in the valve lever, the second follower component being mounted on the eccentric device, and a latching device configured to selectively lock the pivotability of the eccentric device relative to the valve lever, wherein the valve lever and the eccentric device are configured such that, when the pivotability of the eccentric device relative to the valve lever is locked by the latching device, the second follower component translates the contour of the second cam into a corresponding actuation of the engine valve, and when the eccentric device is freely pivotable relative to the valve lever, the first follower component translates the contour of the first cam into a corresponding actuation of the engine valve, wherein the valve lever includes two spaced-apart side parts having an opening dimensioned to bear the eccentric device, the first follower component has a first follower surface disposed concentrically to a rotational axis of the eccentric device, and the first follower surface is accessible between the side parts for abutment on the first cam.

3. A device according to claim 2, wherein the first follower component comprises a roller that is disposed concentrically to the rotational axis of the eccentric device.

4. A device according to claim 3, wherein the eccentric device is pivotably borne in a bushing disposed in the opening of the side parts, and the first follower surface is defined by the roller.

5. A device according to claim 4, wherein the second follower element comprises a roller supported on a bearing pin that protrudes laterally from the eccentric device, the bearing pin being radially displaced from the rotational axis of the eccentric device.

6. A device according to claim 5, further comprising a spring supported between the eccentric device and the valve lever, the spring urging the eccentric device in the direction of abutment of the second follower component on the second cam.

7. A device according to claim 6, wherein the latching device includes a connecting lever connected with the eccentric device so as to rotate therewith, the connecting lever being latchable to the valve lever when the second follower component abuts on a base circle of the second cam.

8. A device according to claim 7, wherein the latching device comprises a locking component slidably supported on the valve lever, the locking component being reciprocally movable between a first position, in which the pivotability of the connecting lever is prevented, and a second position, in which the connecting lever is permitted to pivot.

9. A device according to claim 8, wherein the locking component is formed as a shift pin that is displaceable against an urging force of a spring by application of hydraulic pressure to the shift pin.

10. A device according to claim 9, wherein the engine-mounted component comprises a hydraulic valve play-compensating element configured to apply the hydraulic pressure to the shift pin.

11. A device according to claim 10, wherein a second follower component is provided on each side of the eccentric device and the camshaft has at least two second cams, the second follower components respectively interacting with the second cams.

12. A device according to claim 11, wherein the first cam has a contour that defines a null actuation of the engine valve.

* * * * *